US009573075B1

(12) United States Patent
Capriola et al.

(10) Patent No.: US 9,573,075 B1
(45) Date of Patent: Feb. 21, 2017

(54) ILLUMINATED TOY CONSTRUCTION APPARATUS

(71) Applicants: Gavin Capriola, Sarasota, FL (US); Devin Capriola, Sarasota, FL (US)

(72) Inventors: Gavin Capriola, Sarasota, FL (US); Devin Capriola, Sarasota, FL (US)

(73) Assignee: Kids Toy Clab, LLC., Sarasota, FL (US)

( * ) Notice: Subject to any disclaimer, the term of this patent is extended or adjusted under 35 U.S.C. 154(b) by 0 days.

(21) Appl. No.: 15/156,413

(22) Filed: May 17, 2016

(51) Int. Cl.

| | |
|---|---|
| ***A63H 3/16*** | (2006.01) |
| ***A63H 33/04*** | (2006.01) |
| ***A63H 3/00*** | (2006.01) |
| ***A63H 33/06*** | (2006.01) |
| ***F21V 23/04*** | (2006.01) |
| *F21Y 101/02* | (2006.01) |

(52) U.S. Cl.
CPC ..... *A63H 33/042* (2013.01); *A63H 3/006* (2013.01); *A63H 3/16* (2013.01); *A63H 33/062* (2013.01); *F21V 23/0407* (2013.01); *F21Y 2101/02* (2013.01)

(58) Field of Classification Search
CPC ..... A63H 3/006; A63H 3/16; A63H 3/365; A63H 33/04; A63H 33/062; A63H 33/088
See application file for complete search history.

(56) References Cited

U.S. PATENT DOCUMENTS

| | | | | | |
|---|---|---|---|---|---|
| 2,106,148 | A * | 1/1938 | Kellner | A63H 3/16 | 366/326.1 |
| 2,662,335 | A * | 12/1953 | Calverley | A63H 3/16 | 446/120 |
| 3,589,056 | A * | 6/1971 | Glass | A63H 33/108 | 385/147 |
| 3,634,678 | A * | 1/1972 | Glass | G02B 6/0001 | 362/122 |
| 4,356,659 | A * | 11/1982 | Clarke | A63H 3/40 | 446/97 |
| 4,548,590 | A * | 10/1985 | Green | A63H 33/065 | 403/354 |
| 5,743,782 | A * | 4/1998 | Glynn | A23G 3/28 | 362/253 |
| 8,210,891 | B2 * | 7/2012 | Brumagin | A63H 3/46 | 446/376 |
| 8,998,670 | B1 * | 4/2015 | De Leon | A63H 3/16 | 446/97 |
| 2011/0059674 | A1 * | 3/2011 | Barcelo | A63H 33/101 | 446/97 |

* cited by examiner

*Primary Examiner* — John Ricci
(74) *Attorney, Agent, or Firm* — Andrew S. Rapacke

(57) ABSTRACT

An illuminated toy construction apparatus including a plurality various shaped building members which are configured to be "popped" together to create a variety of characters and objects. Some of the building members include a docking cup and fitting while others are releasably connected by aligning with one another and "popping" together. The building members including a nipple fitting may be attached within a dimensioned channel to create a semi-rigid joint while the disc-shaped members form a hermetically sealed sphere. Further included is a base member which may be releasably connected to other adjacent members and further encloses at least one light emitting diode, motor, and base wheelset to allow the apparatus to move along a flat surface and create an interactive futuristic character or object.

19 Claims, 7 Drawing Sheets

ILLUMINATED TOY CONSTRUCTION APPARATUS

FIELD

The embodiments presented relate to an illuminated toy construction apparatus, and in particular, to an illuminated toy construction apparatus comprised of a plurality of building members which are "popped" together to create a variety of personalized interactive objects.

BACKGROUND

Children of all ages have used construction toy systems for many decades. The first erector sets were comprised of metal fittings using basic nuts and bolts, which enabled children in the 1920s to construct basic structures. Though these early games were challenging or physically demanding to create, they revolutionized a play pattern that has quickly become a staple in the global toy industry.

Today, many popular toy construction companies such as LEGOS® utilize rectangular shaped blocks which make connecting these pieces relatively easy. Though these designs are easily assembled, the uniform shape and configuration of the blocks limits the user's ability to manipulate models once initially connected.

Further construction sets have attempted to employ more user-friendly connectors which allow for flexible joints using hooks, snaps, or v-shapes. However, these designs were often expensive, and the connectors often failed after only a few uses.

Currently, there are several toy construction sets that have integrated a light source within their building blocks. Specifically, U.S. Pat. No. 8,371,894 to Rosen/Dattari; U.S. Pat. App. No. 20140349544 to Chien; and U.S. Pat. App. No. 20130109268 to Lin. However, despite their respective advantages, these references do not disclose an illuminated toy construction set where the building members may be "popped" together or create a semi-flexible joint using a nipple fitting.

SUMMARY OF THE INVENTION

Embodiments presented provide to an illuminated toy construction apparatus which may comprise a plurality of building member configured to be releasably connected by "popping" the building members together to create a variety of interactive multi-generational toy characters and objects. The embodiments enable the user to "pop" spherical-shaped, elongated, and base members using a nipple fitting and cushioned grommet to one another to form a semi-rigid joint which may be transitioned along a dimensioned groove or rotated about an axis. Further, the embodiments provide a plurality of disc-shaped members which include a tapered edge and concave furrow which may be releasably connected by aligning and "popping" together to create a hermetically sealed sphere. The base member further includes at least one Light Emitting Diode, which may be aligned in a variety of configurations to further personify the character or object.

The embodiments are comprised of spherically-shaped, disc-shaped, elongated and base members which may be releasably connected to form a semi-rigid joint using an outward extending docking cup and nipple fitting. The nipple fitting located at the center of the docking cup further includes a cushioned grommet about its diameter which is designed to flex when inserted and extracted from the dimensioned groove. The dimensioned groove further acts to anchor the nipple fitting within the dimensioned channel and prevent the semi-rigid joint from disconnecting.

Some embodiments provide a decorative construction character with a variety of customized accessories which enhance personification and create a customized multi-generation gender neutral toy. These customized accessories, when combined with the configured LEDs within the base unit, create a futurist illusion. Further provided is a motor and base wheelset which allows the apparatus to travel along a surface.

Other aspects, advantages, and novel features of the embodiments presented will become apparent from the following detailed description in conjunction with the drawings.

BRIEF DESCRIPTION OF THE DRAWINGS

A more complete understanding of these embodiments, and the attendant advantages and features thereof, will be more readily understood by reference to the following detailed descriptions when considered in conjunction with the accompanying drawings. The drawings described herein may not be to scale, are for illustrative purposes only of selected embodiments and do not depict all possible implementations, and are not intended to limit the scope of the present disclosure.

DETAILED DESCRIPTION

The specific details of a single embodiment or variety of embodiments described herein are set forth in the presented embodiments. Any specific details of the embodiments are used for demonstration purposes only, and no unnecessary limitations or inferences are to be understood therefrom.

The embodiments shown relate to an illuminated toy construction set further comprised of a plurality of spherically-shaped, disc-shaped, and elongated building members which releasably attach by "popping" the building members together to create a variety of customized characters and objects. Further, the base member may include a motor and at least one light emitting diode which when energized, enables light to propagate throughout the building members. The embodiments further illustrate how both the spherical-shaped and elongated building members further include a docking cup or dimensioned channel which enable the user to attach the building members releasably together by aligning the nipple fitting with the dimensioned channel and applying optimal pressure to "pop" the two members together. The plurality of disc-shaped building members includes either a male or female connector along the perimeter. When a male-female connector is aligned, they "pop" together to create a single hollow spherical element.

Figure 1:
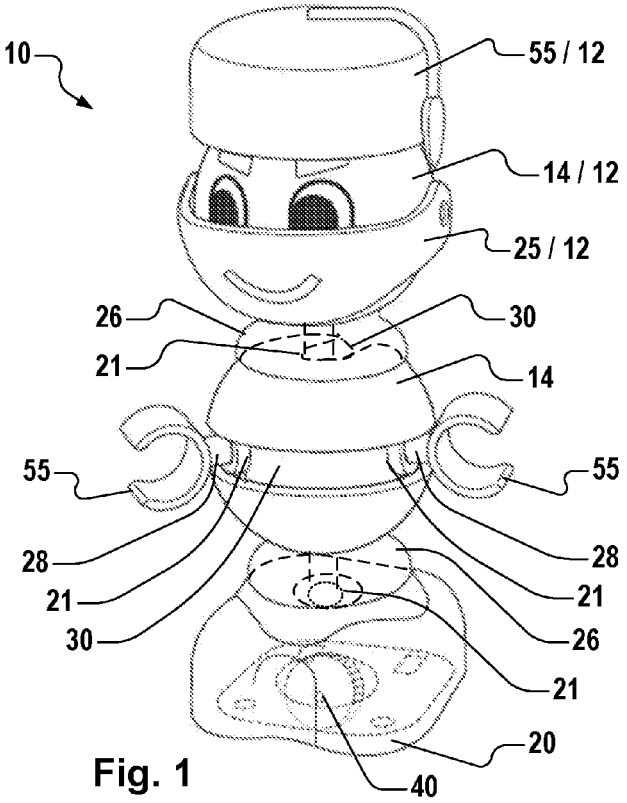
FIG. 1 is a perspective view of an illuminated toy construction apparatus.

Referring now to the drawings wherein, like reference numerals designate identical or corresponding parts throughout the views. There is shown in FIG. 1 a perspective view of an illuminated toy construction apparatus 10 comprised of a plurality of building members 12 releasably connected to create a variety of customized characters and objects. The plurality of building members' 12 include spherical-shaped 14, disc-shaped 16, elongated 18, and base 20 members which are designed to "pop" together by compressing any two building members 12 with the slightest force to create a single semi-rigid joint. It is contemplated that apparatus 10 is comprised of a uniform high durometer translucent material such as plastic or polyurethane which is malleable to allow building elements 12 to flex and be "popped" together using the slightest amount of force. The translucent properties of the material enable a light source 24 to be illuminated from the base member 20 and propagate through any connected building members 12 providing an illusion that each building member 12 is independently lit. Further, the uniform thickness allows light to be easily propagated from one building member 12 to the next. The material and light source 24 may be interchanged with a variety of color scheme which when used in conjunction with customized accessories, provide enhanced personalization to create a multi-generational and gender neutral, interactive toy apparatus 10.

Figure 10:
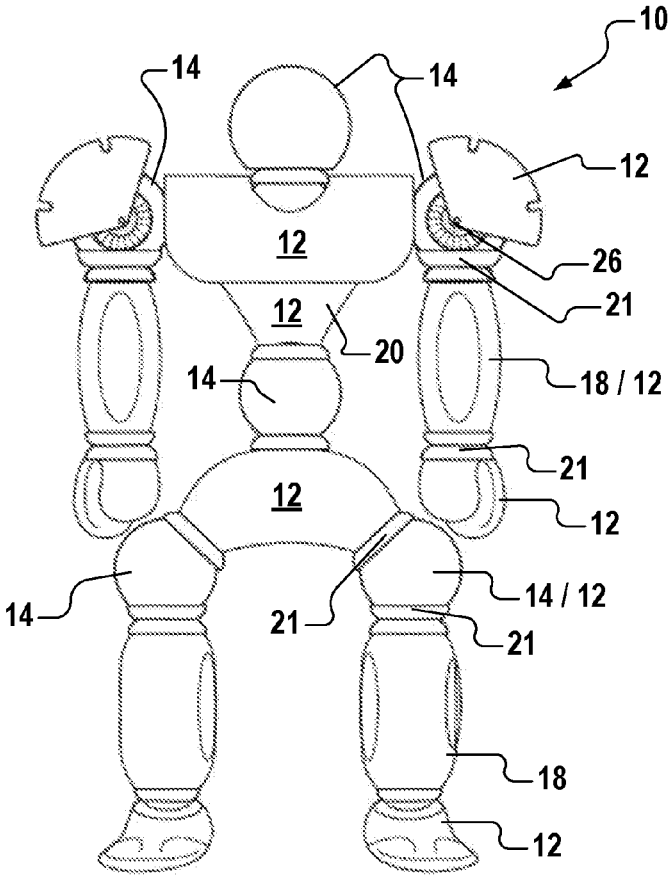
FIG. 10 is an embodiment of the apparatus without customized accessories.
Figure 11:
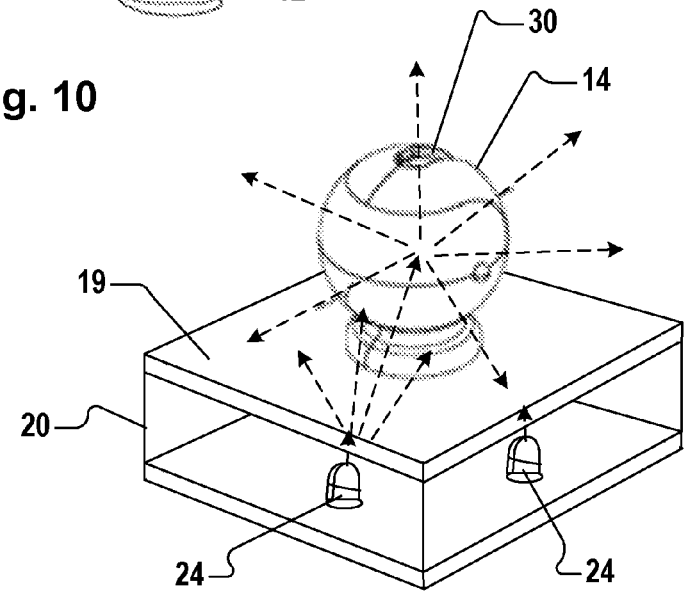
FIG. 11 is a view of the light source illuminating the base and attached building members.

The spherical-shaped building member 14 includes at least one outward protruding docking cup 26 with an integrated nipple fitting 28 at the center. In some embodiments, the spherical-shaped building member 14 may have multiple docking cups 26 aligned in either an opposite or adjacent configuration. For example, as shown in FIG. 10, the shoulder region of the apparatus 10 includes a spherical-shaped building member 14 with adjacent docking cups 26. Further integrated into the center of the docking cup 26 is a cylindrically shaped nipple fitting 28 which slide into, and seats within the dimensioned channel 30 to form a semi-rigid joint. Specifically, the diameter of the nipple fitting 28 is defined by the width of the dimensioned channel 30. Once releasably received with the dimensioned channel 30, both the attached building element 12 and docking cup 26 can transition in a lateral direction throughout the dimensioned channel 30 and further rotate 360 degrees about the axis of the nipple fitting 28.

The nipple fitting 28 remains seated within the dimensioned channel 30 by the cushioned grommet 31 attached about the diameter. The cushioned grommet 31 is composed of a low durometer material which allows for deformation and flexibility while inserting and removing the nipple fitting 32 from a dimensioned channel 30. Specifically, when inserting a nipple fitting 28 into the dimensioned channel 30, the cushioned grommet 31 is compressed between the inside wall of the dimensioned channel 33 and the nipple fitting 28. Once fully inserted within the dimensioned channel 30, the cushioned grommet 31 returns to its original shape where it anchors the nipple fitting 28 within the dimensioned channel 30 and prevents the semi-rigid joint from disconnecting. During disassembly, the user may simply disconnect the semi-rigid joint by pulling the docking cup 26 away from the dimensioned channel 30 to unseat the nipple fitting 28.

The base member 20 has a substantially rectangular configuration enclosing the light source 24 and further including a docking cup 26 located at the top surface which may be releasably connected to either the disc-shaped member 16 or an elongated member 18. The enclosed light source 24 is defined as at least one light emitting diode (LED) electrically coupled to a switch 36 and battery 38 to provide illumination throughout the base member 20 and propagate the light source 24. Some embodiments provide a base member 20 with multiple LEDs aligned in various configurations to optimize propagation to the connected building member 12. The configuration of the LEDs may vary depending on the customized character or object being constructed. For example, if the apparatus 10 is a customized vehicle, the LED's may be configured at the four corners of the base member 20 to provide uniform illumination. However, if the apparatus 10 is a customized character, the LED's may be configured to focus the illumination in a single direction and enhance propagation through each attached building member 12. Further, it is contemplated that the light source 24 may be energized using a variety of activation including touch, motion, and sound. For example, in the preferred embodiment, the light source 44 is activated by depressing the base member one time. The user may initiate a flash mode by depressing the base member 20 two consecutive times, and eventually deactivated by depressing the base member 20 three consecutive times.

Some embodiments of the base member 20 include a wheel set 40 which allow the apparatus 10 to maneuver along a surface. The base wheel set 40 is coupled to the battery 38 which allows the apparatus 10 to glow simultaneously and maneuver to present a highly futuristic interactive character. The user is able to customize the character further by attaching customized accessories 25 onto the desired building member 12. For example, as illustrated in FIG. 1, the customized accessories 25 include a set of eyes, eyebrows, mouth, facemask, hat, and arms. The embodiments may provide customized accessories 25 commonly associated with vehicles, planes, or helicopters such as rims, doors, windows, and headlights. The use of these customized accessories 25 create a degree of personification and enable multiple generations of users to simultaneously participate in the play pattern.

Figure 2:
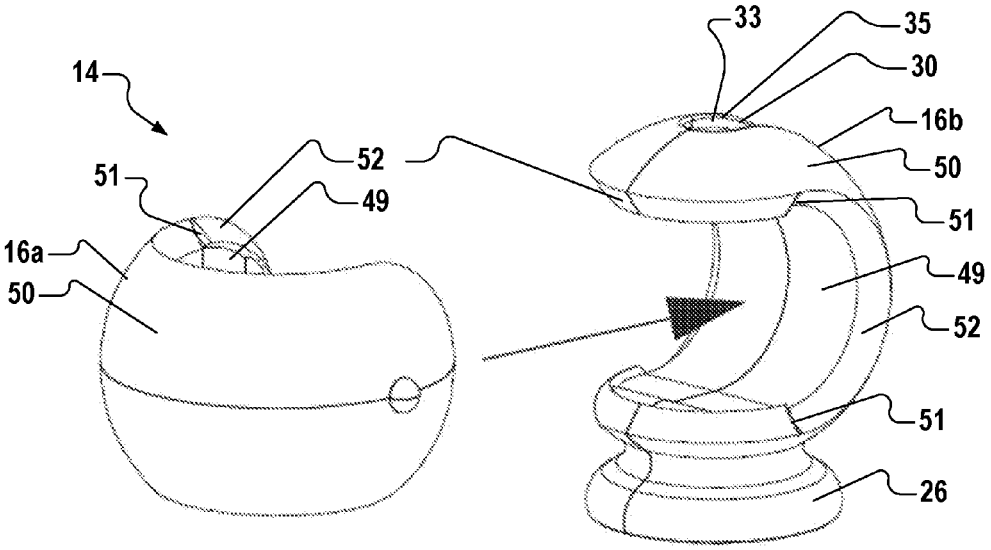
FIG. 2 is a perspective view of the disc-shaped building member.
Figure 2A:
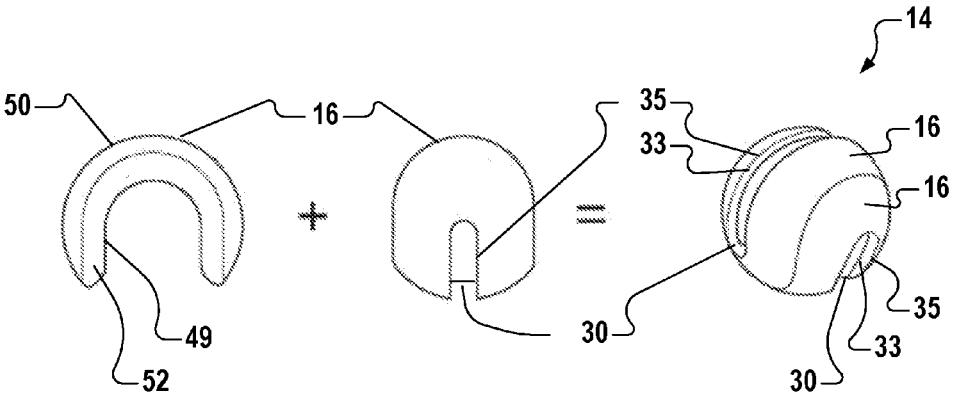
FIG. 2A is a view of both the disc-shaped and spherical-shaped building members.

Referring now to FIG. 2 is a perspective view of a first and second disc-shaped members. Each disc-shaped member 16 includes an inside surface 49, outside surface 50, furrowed groove 51, and tapered edge 52. The uniform configuration of the disc-shaped member 16 enables members to be "popped" together to create a single hermetically sealed sphere by aligning and compressing the two inside surfaces 49. When releasably connected, the tapered edge 52 of the first disc-shaped member creates a hermetic seal with the furrowed groove 51 of the second disc-shaped member. In addition, the malleable material allows the user to flex each disc-shaped member 16 by squeezing the outside surface 50 with a thumb and forefinger. Some embodiments may provide an outside surface 50 with at least one aperture 51 which is dimensioned to fit a nipple fitting 28. For example, in FIG. 1 when constructing the head of the apparatus 10, two disc-shaped members 16 are connected and a customized accessory 25 is connected to aperture 51 to be used as a hat.

Figure 3A:
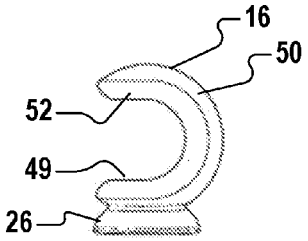
FIG. 3A is a view of the disc-shaped building member including one docking cup.
Figure 3B:
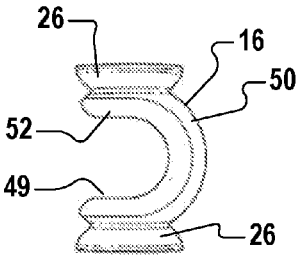
FIG. 3B is a view of the disc-shaped building member including two docking cups.
Figure 3C:
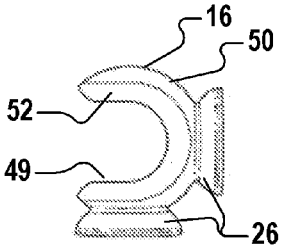
FIG. 3C is a view of the disc-shaped building member including three docking cups.

Referring now to FIGS. 3A-3C are views of the disc-shaped members 16 with one and tow docking cups 26 facing opposite or adjacent to one another both a single and double docking cup 26 in either an opposite or adjacent configuration as demonstrated by the torso of FIG. 1.

Figure 3D:
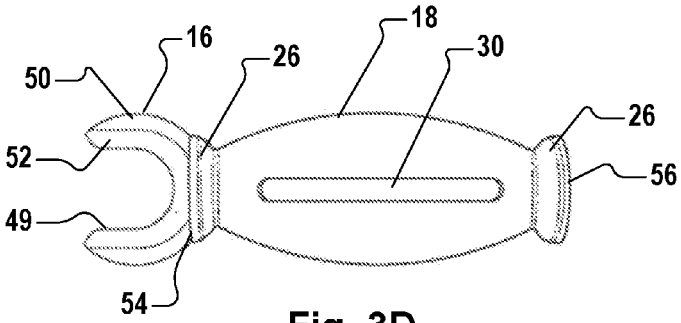
FIG. 3D is a view of an elongated building member including the dimensioned channel.

Referring now to FIG. 3D is a view of an elongated building member 18. The elongated member 18 further includes a docking cup 26 at both the first end 54 and a second end 56. The elongated member 18 further includes at least one dimensioned channel 30 with a releasably connected disc-shaped member 16 at the first end 54. In the current view, the disc-shaped member may be rotated 360 degrees about the first end nipple fitting 54 demonstrated by the arms and hands of FIG. 10.

Figure 4A:
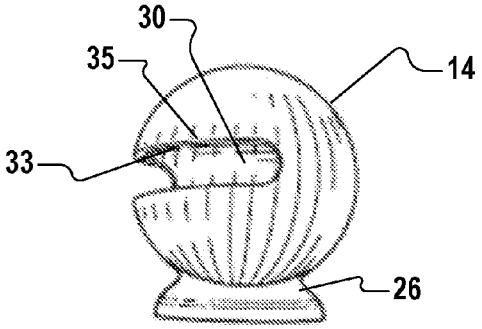
FIG. 4A is a perspective view of the spherical-shaped building member including the dimensioned channel.
Figure 4B:
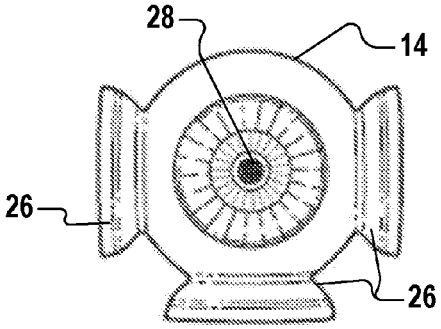
FIG. 4B is a view of a further spherical-shaped building member including a plurality of docking cups.

Referring now to FIGS. 4A and 4B, which provides detailed views of the spherical-shaped building members 14 including at least one docking cup 26 aligned in various configurations as demonstrated by the shoulders of FIG. 10.

Figure 5:
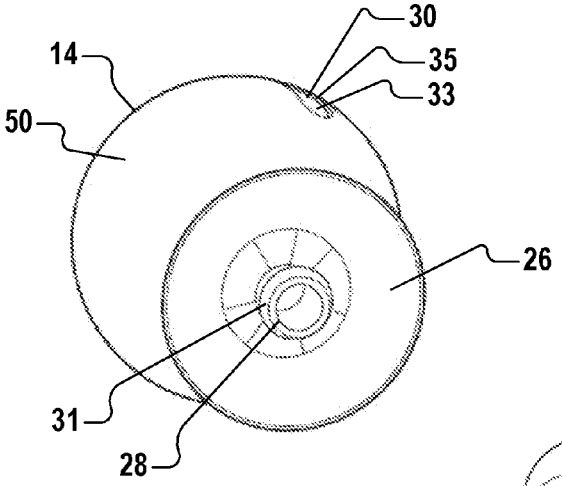
FIG. 5 is a detailed view of a docking cup and nipple fitting.
Figure 6:
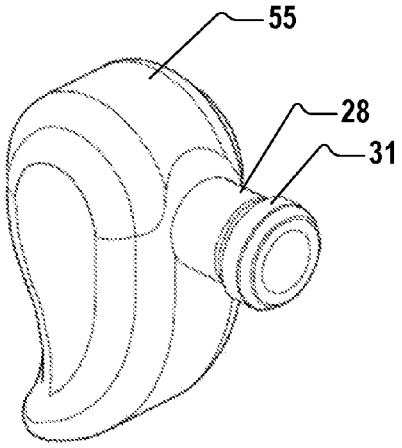
FIG. 6 is a detailed view of the nipple fitting and cushioned grommet.

Referring now to FIG. 5 is a detailed view of the docking cup 26 and integrated nipple fitting 28, which when releasably connected form a semi-rigid joint. Further, as shown in FIG. 6, the nipple fitting 28 may be included with a customized accessory 55 as demonstrated by the arms in FIG. 8A.

Figure 7:
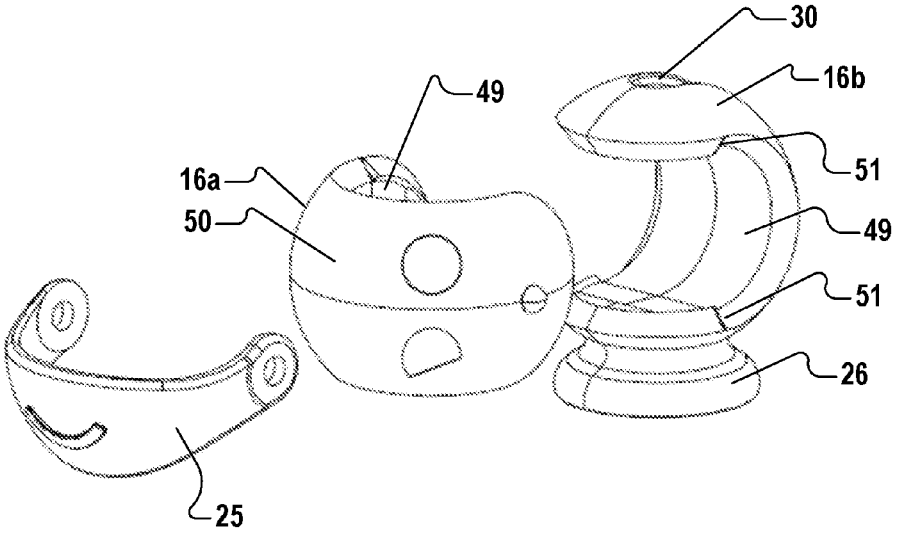
FIG. 7 is an exploded view of a plurality of disc-shaped members aligned for attachment.
Figure 7A:
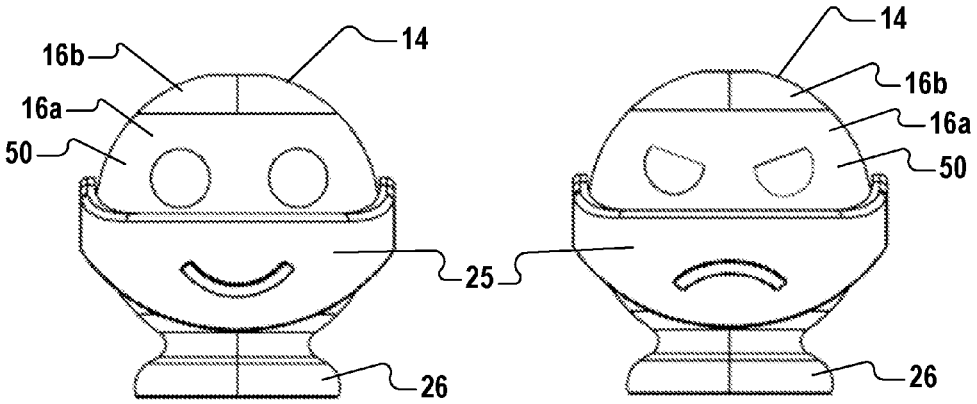
FIG. 7A is a view of a fully constructed and customized apparatus.

Referring now to FIG. 7 is a view of the disc-shaped member 16 aligned with each inside surface 40 facing opposite each other. Further shown, are the customized accessories 25 used as the mouth and facemask on the apparatus 10. Shown in FIG. 7A is a view of the disc-shaped members 16 "popped" together with a variety of customized accessories attached. As demonstrated in the current embodiment, the customized accessories 25 are reversible and allow the user to create a similar character with multiple personalities.

Figure 8:
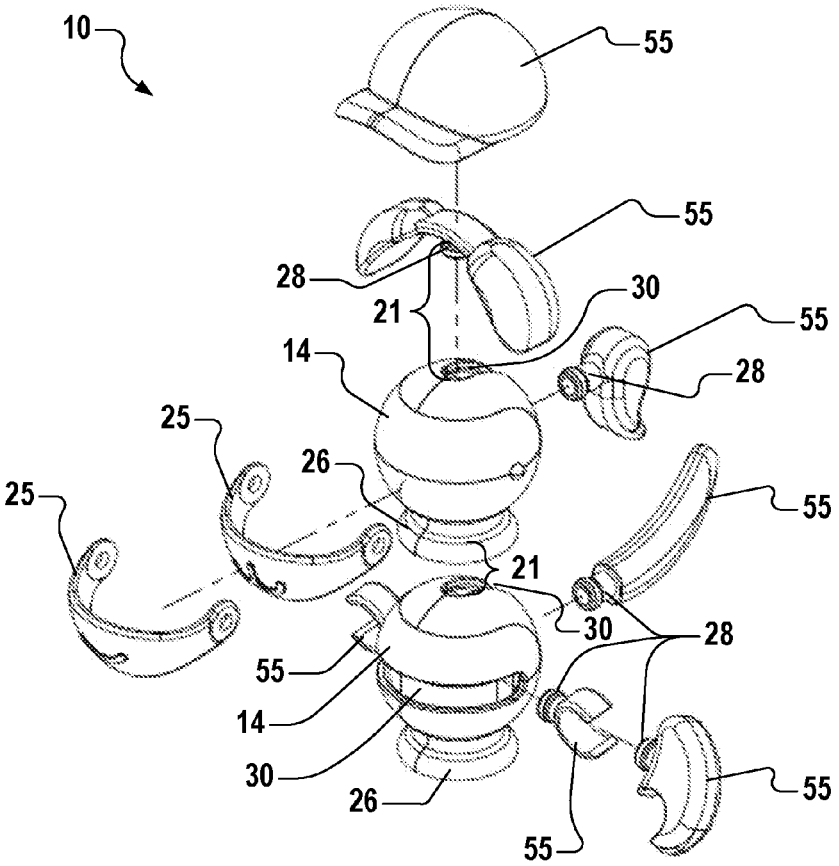
FIG. 8 is a view of a customized character aligned for attachment.
Figure 8A:
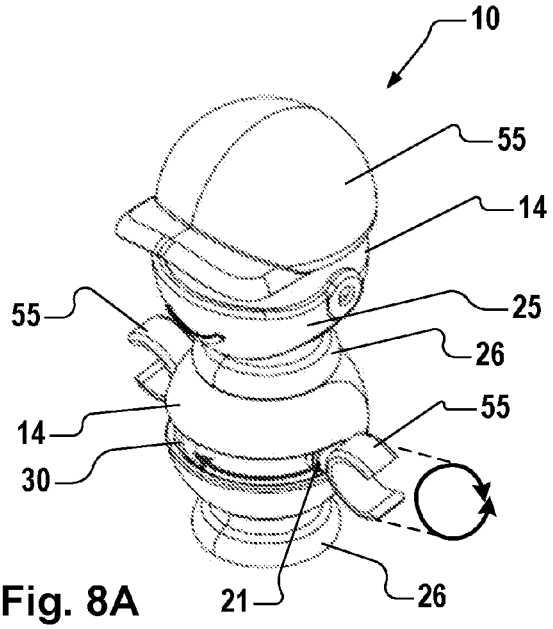
FIG. 8A is a further view of the customized character attached.

Referring now to FIG. 8 is a view of building elements 12 aligned to create a customized character. Further shown is a view of the customized accessories with a nipple fitting 55. These insertable accessories function as hats, shoulders, feet, tails, arms, and hands which when releasably attached are shown in FIG. 8A. As shown in FIG. 1 is a further view of customized accessories with a nipple fitting end 55 used as arms which traverse laterally along the dimensioned channel 30.

Figure 9:
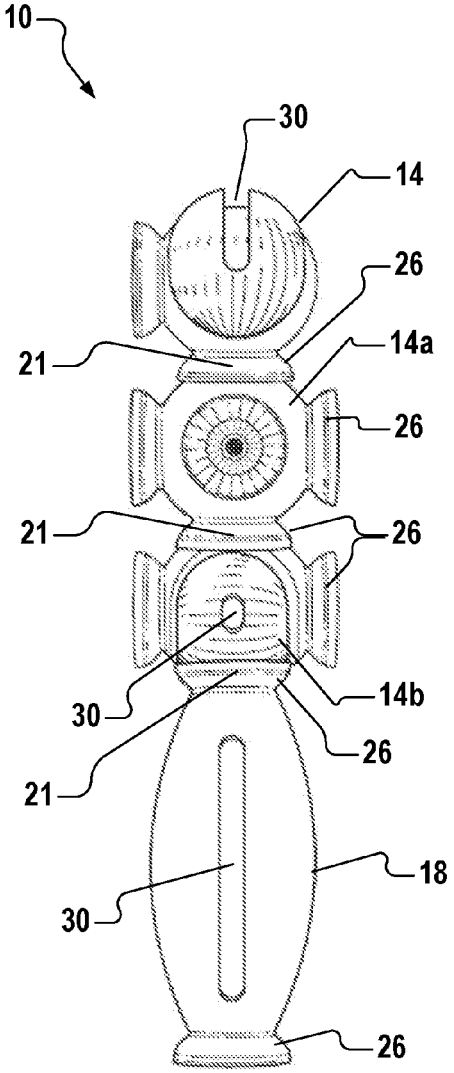
FIG. 9 is a view of a spherical-shaped member attached to a disc-shaped member.
Figure 9A:
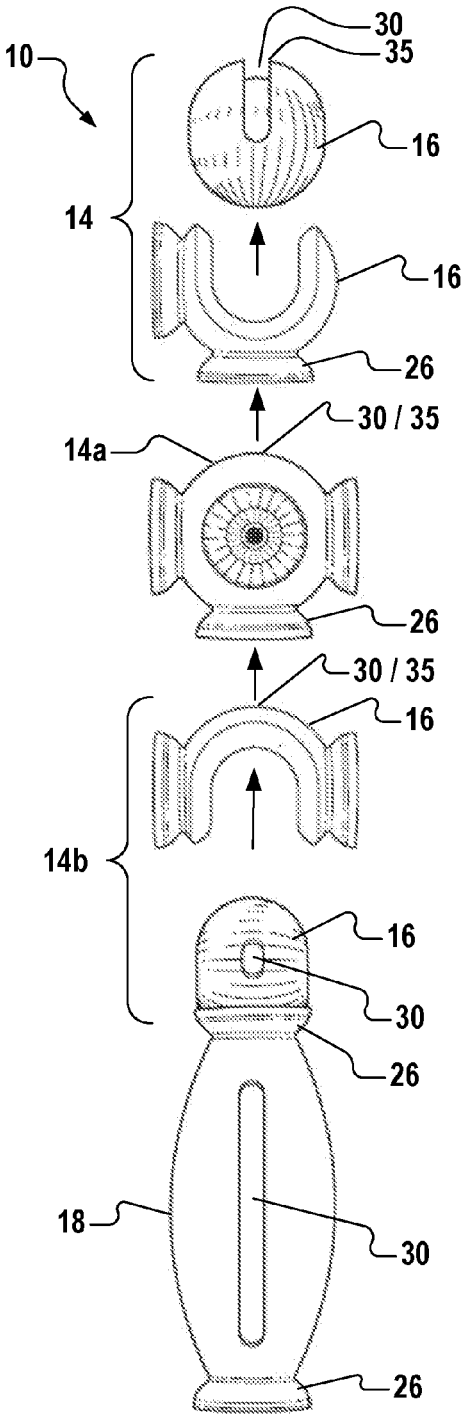
FIG. 9A is a view of spherical-shaped and disc-shaped members aligned to an elongated building member.

Referring now to FIG. 9 and FIG. 9A, which provides a view of the apparatus being disassembled. As shown in FIG. 9, the apparatus 10 may be disassembled by pulling the spherical-shaped member 14 from the inside surface of the disc-shaped member 49. Once detached, the disc-shaped member 16 may be pulled away from spherical-shaped member 14.

It will be appreciated by persons skilled in the art, that the present embodiments are not limited to what has been particularly shown and described hereinabove. A variety of modifications and variations are possible in light of the above teachings without departing from the following claims.

What is claimed is:

1. An illuminated snap-together toy building apparatus, the apparatus comprising:

at least one substantially cylindrical building member having at least one nipple fitting within a docking cup about a perimeter;

at least one substantially cylindrical building member having at least one elongated channel and dimensioned to integrally receive the at least one nipple fitting within the docking cup;

a first disc-shaped building member releasably connected to a second disc-shaped member to create a hermetically sealed hollow sphere;

a substantially elongated building member including the dimensioned channel about a portion and the at least one nipple fitting within a docking cup at an end;

a base member configured to provide a light source to at least one releasably connected building member.

2. The apparatus of claim 1, wherein the nipple fitting further includes a cylindrical shaped cushioned grommet configured to secure the nipple fitting within the elongated channel.

3. The apparatus of claim 2, wherein the nipple fitting is further configured to transition along the dimensioned channel and selectively rotate about an axis of the nipple fitting when releasably connected.

4. The apparatus of claim 1, wherein the plurality of disc-shaped members are releasably connected by at least aligning and depressing a tapered edge along a perimeter of the first disc-shaped member with a concave furrow of the second disc-shaped member.

5. The apparatus of claim 1, further comprising a translucent portion to enable the light source to be transferred from the base member to a releasably connected building member.

6. The apparatus of claim 1, wherein the light source is further comprised of at least one Light Emitting Diode further configured to be activated upon depressing the base member at least one time.

7. The apparatus of claim 6, wherein the light source is further configured to flash for a predetermined frequency when the base member is depressed a preprogrammed number of times.

8. The apparatus of claim 1, wherein the base member further includes a wheel set to maneuver the apparatus in a direction.

9. The apparatus of claim 1, wherein the apparatus further includes a plurality of customized accessories to provide a user to personalize the apparatus.

10. The apparatus of claim 9, wherein the customized accessories further include at least eyes, ears, nose, mouth, facemask, and hat.

11. An interactive illuminated toy construction apparatus, the apparatus comprising:

at least one substantially cylindrical building member having at least one nipple fitting and dimensioned to be releasably connected to a dimensioned channel to create a semi-rigid joint;

a first disc-shaped building member including a docking cup or a dimensioned channel and configured to be releasably connected to a second disc-shaped member at a concave furrow by at least snapping the first disc-shaped member into the second disc-shaped member to create a hermetically sealed hollow sphere;

a substantially elongated building member further including a docking cup at a first and a second end;

a substantially elliptical base member including a light source and configured to be releasably connected at a top surface to the at least one substantially cylindrical building member or the substantially elongated building member and enable an illumination to the at least one building member.

12. The apparatus of claim 11, wherein the apparatus is further comprised of a malleable and translucent material.

13. The apparatus of claim 11, wherein the nipple fitting further includes a cushioned grommet about a diameter to allow the nipple fitting to transition in a lateral direction within the dimensioned channel.

14. The apparatus of claim 13, wherein the cushioned grommet is further configured to enable the at least one substantially cylindrical building member to rotate about an axis of the nipple fitting while releasably connected within the dimensioned channel.

15. The apparatus of claim 11, wherein the first disc-shaped member further includes a tapered edge and a concave furrow about is configured to enable a user to releasably snap the first disc-shaped member to the second disc-shaped member by at least aligning and squeezing.

16. The apparatus of claim 11, wherein the light source further includes at least one Light Emitting Diode.

17. The apparatus of claim 16, wherein the light source is further configured to be energized upon a depression of the base unit.

18. The apparatus of claim 11, wherein the base member further includes a base wheelset electrically coupled to a motor to provide a movement to the apparatus.

19. An interactive illuminated toy construction apparatus including a plurality of translucent building members, the apparatus comprising:

at least one substantially cylindrical building member having at least one nipple fitting and cushioned grommet to provide a semi-rigid connection while releasably seated within a dimensioned channel;

a first disc-shaped building member configured to be releasably connected to a second disc-shaped member at a first concave surface or the at least one nipple fitting at a second outside surface;

a substantially elongated building member further including a docking cup at a first and a second end;

a rectangular base member including at least one Light Emitting Diode configured to releasably connect to at least one of the plurality of building member at a first surface and further provide an illumination through the plurality of building members.

* * * * *